United States Patent [19]

Kershaw

[11] Patent Number: 4,638,988

[45] Date of Patent: Jan. 27, 1987

[54] SHEET STACK SUPPORT TRAYS

[75] Inventor: Ian G. Kershaw, Old Stevenage, United Kingdom

[73] Assignee: Xerox Corporation, Stamford, Conn.

[21] Appl. No.: 742,497

[22] Filed: Jun. 7, 1985

[30] Foreign Application Priority Data

Jun. 22, 1984 [GB] United Kingdom ..... 8416015

[51] Int. Cl.[4] ..... B65H 1/00

[52] U.S. Cl. ..... 271/171; 221/242; 271/223; 271/240

[58] Field of Search ..... 271/171, 223, 224, 238, 271/240, 253, 254, 255, 169, 3.1; 221/242

[56] References Cited

U.S. PATENT DOCUMENTS

| | | | |
|---|---|---|---|
| 141,491 | 8/1873 | Clark | 271/214 |
| 1,780,348 | 11/1930 | Eckhard | 271/240 |
| 3,334,894 | 8/1967 | Van Acker | 271/169 |
| 3,862,753 | 1/1975 | Giorgini | 271/171 |
| 4,395,036 | 7/1983 | Bergman et al. | 271/171 |
| 4,457,507 | 7/1984 | Ishikawa et al. | 271/171 |
| 4,480,824 | 11/1984 | Acquaviva | 271/3.1 |

FOREIGN PATENT DOCUMENTS

| | | | |
|---|---|---|---|
| 2551497 | 5/1977 | Fed. Rep. of Germany | 271/223 |

OTHER PUBLICATIONS

"Paper Tray Side Guides", B. J. Riley, Xerox Disclosure Journal; vol. 4, No. 5, Sep./Oct. 1979, pp. 627–628.

*Primary Examiner*—John J. Love
*Assistant Examiner*—John A. Carroll

[57] ABSTRACT

A stack support tray 41 for use with a sheet feeder such as used in a document handler is described. It has a first fixed registration guide 52 and a second movable registration guide 53 which is movable towards and away from the first guide. The movable guide 53 comprises first and second resiliently interconnected parts 71, 72. The part 72 frictionally slides in a track 75 and the second part 71 is adjustable against the stack. By this arrangement the part 71 retracts to a limited extent when it is released after being pushed against the stack due to its resilient interconnection with the part 72, the position of which is controlled by its frictional engagement with the slide track 75.

2 Claims, 12 Drawing Figures

SHEET STACK SUPPORT TRAYS

This invention relates to stack support trays for receiving a stock of sheets from which the sheets are advanced or fed one at a time. It also relates to sheet feeders incorporating such trays.

Stack support trays have various applications particularly in sheet feeders and here it is important that the stack be positioned in registration with the feeder so that all the sheets in the stack will be properly presented to the feeder. To this end the stack is normally registered in the tray against registration stops and it is common for a movable guide to be withdrawn during insertion of the stack into the tray and then moved against an edge of the stack which has already been loaded against another registration edge by the operator. A problem arises particularly when registering small stacks of sheets as often occurs in a document feeder that the operator pushes the movable guide too firmly against the stack so that it becomes partly wedged in the tray and in some instances curled so that feeding is impaired. It is an object of the present invention to alleviate this problem.

According to the present invention there is provided a stack support tray having a first fixed registration guide and a second movable registration guide movable towards and away from the first guide, said movable guide comprising first and second resiliently interconnected parts, one of which frictionally slides in a track and the second of which is adjustable against the stack, whereby the second part retracts to a limited extent when it is released after being pushed against the stack due to its resilient interconnection with said first part the position of which is controlled by its frictional engagement with said slide track.

Such a stack support tray is equally suitable for use in sheet feeders for feeding blank sheets of paper in a copy processor and for feeding documents to be copied such as in an automatic document feeder or a recirculation document feeder. Further the tray may be used in a bottom sheet feeder in which sheets are advanced one at a time from the bottom of the stack or in a top sheet feeder in which the sheets are advanced one at a time from the top of the stack.

From another aspect the invention provides an automatic sheet feeder incorporating a stack tray as described above.

Because of the frequent use of small stacks in the stack trays of automatic document heandlers the invention has particular application to sheet feeders used in such document handlers. To this end from still another aspect the invention provides an automatic document handler incorporating a sheet feeder having a stack tray as described above.

Figure 1:
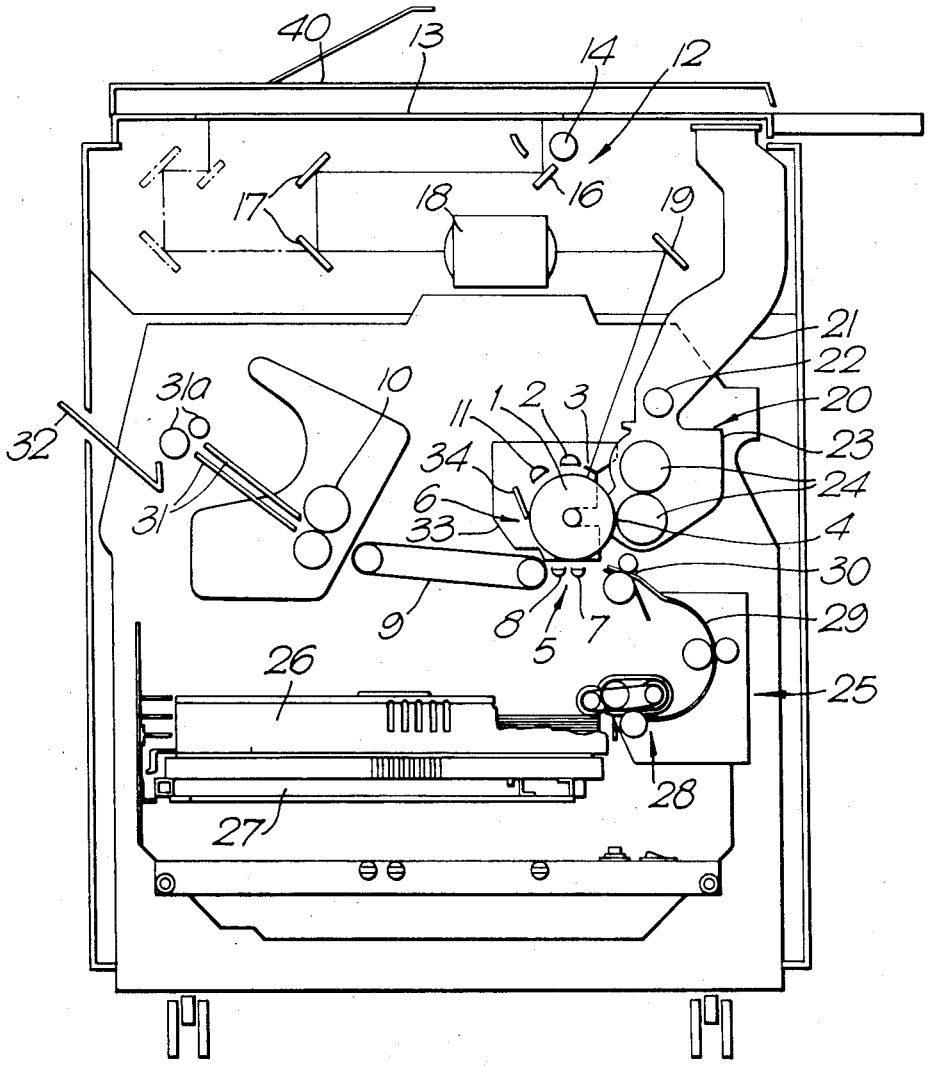
Figure 2:
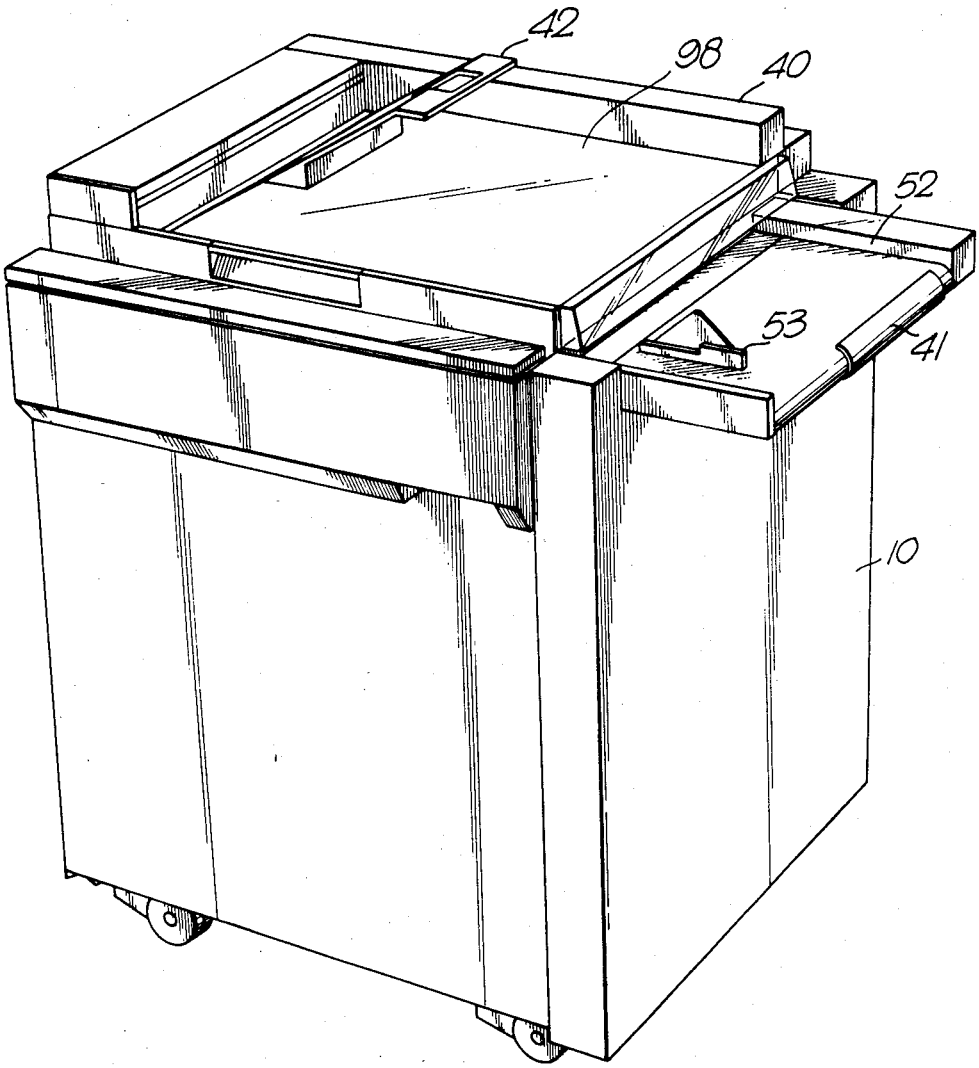
Figure 3:
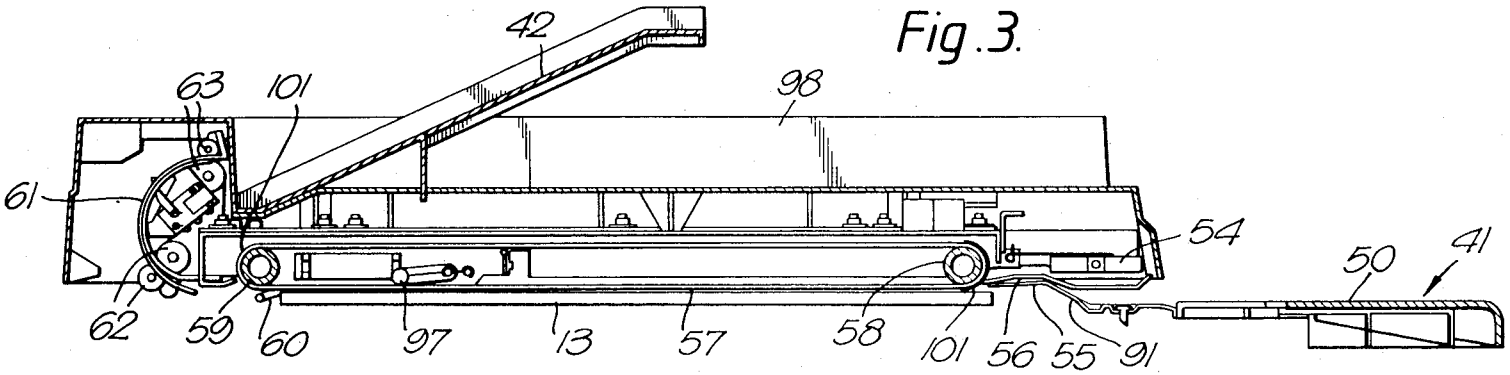
Figure 4:
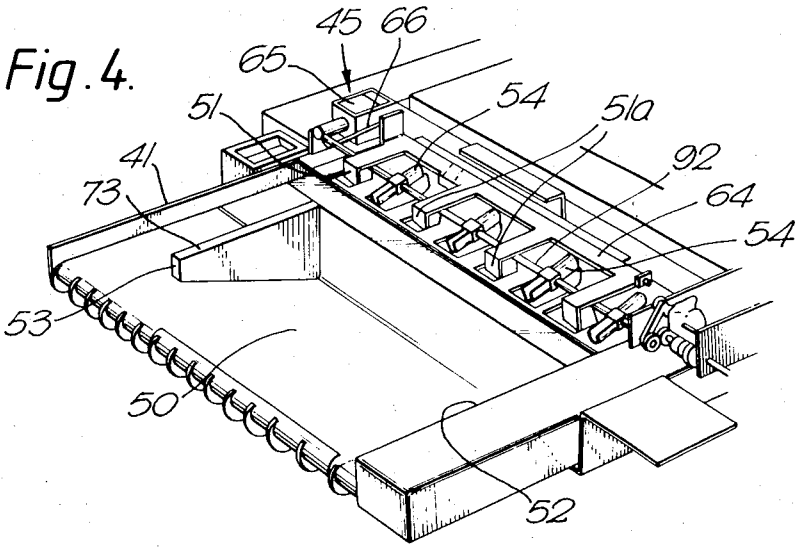
Figure 5:
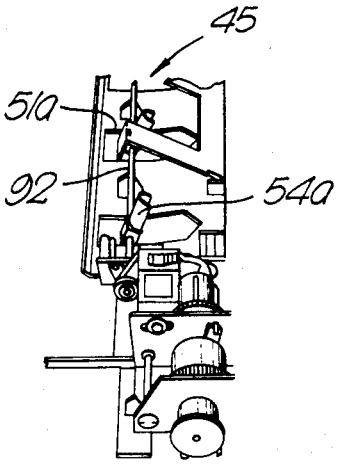
Figure 6:
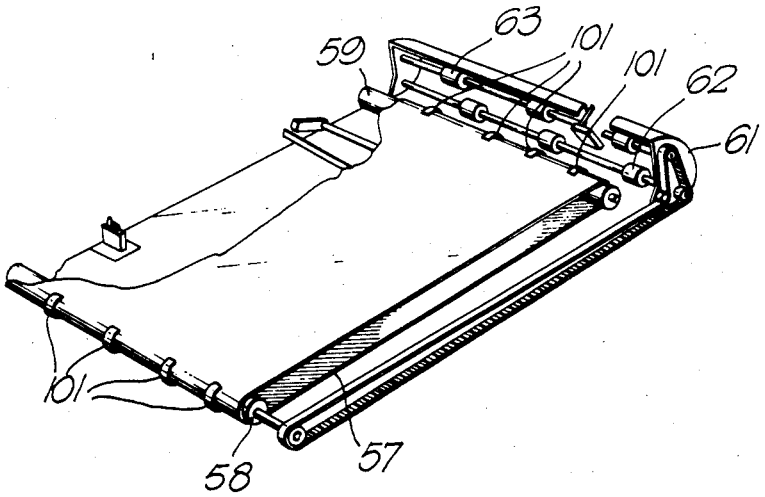
Figure 7:
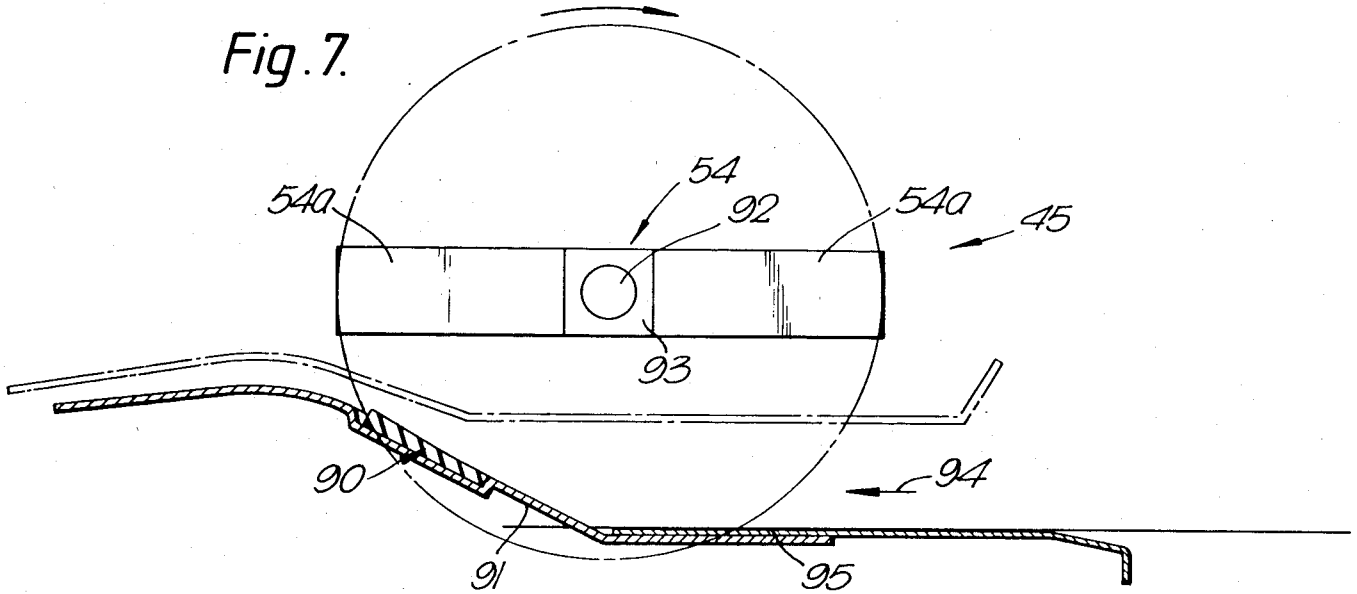
Figure 8:
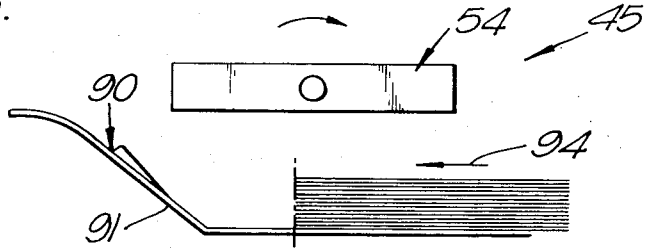
Figure 9:
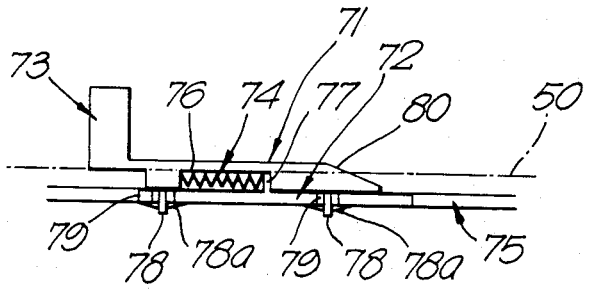
Figure 10:
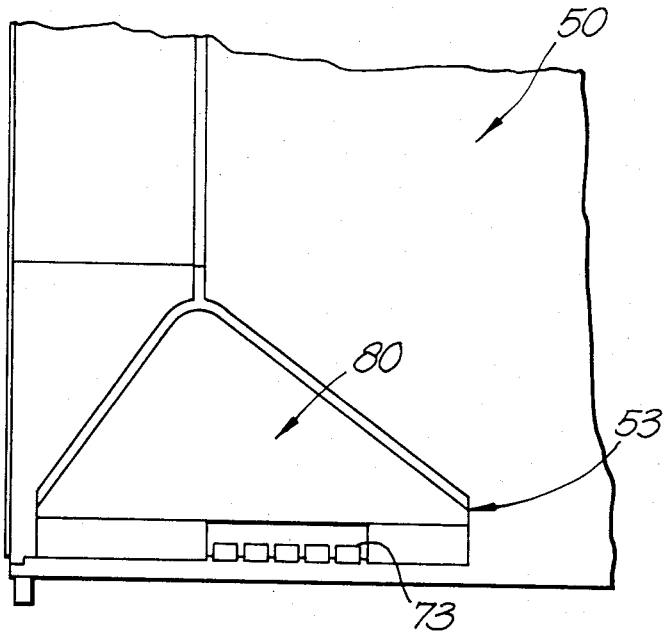
Figure 11:
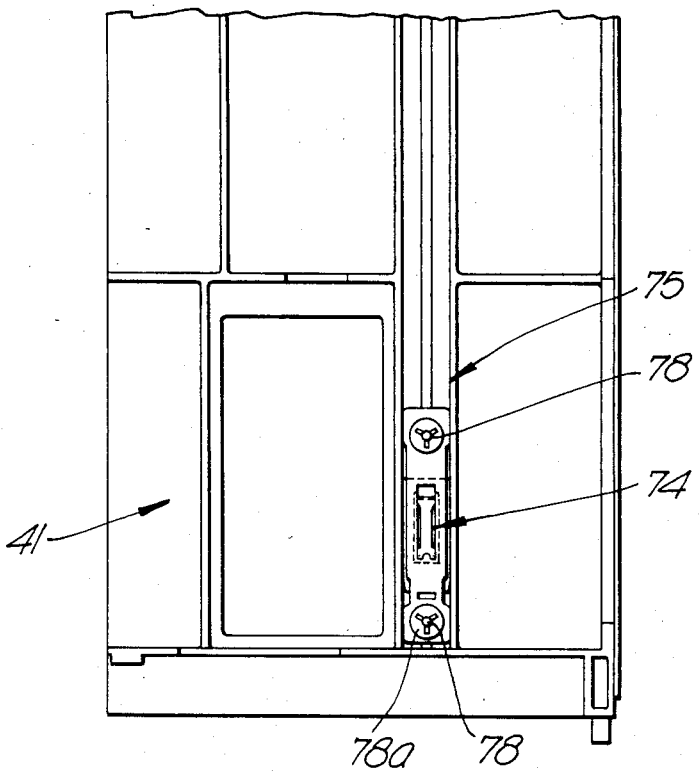
Figure 12:
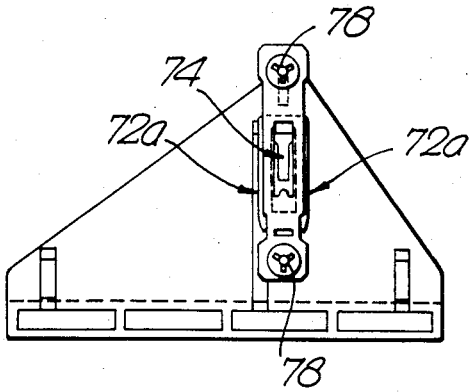

In order that the invention may be more readily understood reference will not be made to accompanying drawings, in which;

FIG. 1 is a schematic side elevation of a copier incorporating an automatic document handler according to the invention, FIG. 2 is a perspective view from above of the copier showing the external appearance of the document handler, FIG. 3 is a schematic cross-section of the document handler taken from one side, FIG. 4 is a perspective view from above of the input end of the document handler, FIG. 5 is a scrap view taken from above of the sheet feeder of the document handler, FIG. 6 is a top perspective view of the document handler with the cover removed showing the platen transport mechanism thereof, FIG. 7 is a scrap cross-section of the sheet feed area of the document handler, FIG. 8 is a schematic side elevation of the area shown in FIG. 7 with the location of the sheet stack indicated, FIG. 9 is a schematic side elevation of the sheet registration mechanism of this invention, FIG. 10 is a top plan view of part of the stack tray showing the adjustable registration guide, FIG. 11 is an underneath plan view of the stack tray, and FIG. 12 is a underneath plan view of the registration guide shown removed from the stack tray.

Referring first to FIG. 1 there is shown a xerographic copying machine incorporating an automatic document handler 40 according to the present invention. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image seletively discharges the photoconductor in image configuration, whereby an electrostatic latent image of the object is laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corotron 7 provides an electric field to assist inthe transfer of the toner particles thereto. The copy sheet is then stripped from the drum 1, the detachment being assisted by the electric field provided by an a.c. de-tack corotron 8. The copy sheet carrying the developed image is then carried by a transport belt system 9 to a fusing station 10.

After transfer of the developed image from the drum, some toner particles usually remain on the drum,and these are removed at the cleaning station 6. After cleaning, any electrostatic charges remaining on the drum are removed by an a.c. erase corotron 11. The photoreceptor is then ready to be charged again by the charging corotron 2, as the first stop in the next copy cycle.

The optical image at imaging station 3 is formed by optical system 12. A document (not shown) to be copied is palced on platen 13, and is illuminated by a lamp 14 that is mounted on a scanning carriage which also carries a mirror 16. Mirror 16 is the full-rate scanning mirror of a full and half-rate scanning system. The full-rate mirror 16 reflects an image of a strip of the document to be copied onto the half-rate scanning mirror 17. The image is focussed by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan.

At the developement station 4, a magnetic brush developer system 20 develops the electrostatic latent image. Toner is dispensed from a hopper 21 by means of a rotating foam roll dispenser 22, into developer housing 23. Housing 23 contains two-component developer mixture comprising a magnetically attractable carrier and the toner, which is brought into developing engagment with drum 1 by a two-roller magnetic brush developing arrangement 24.

The developed image is transferred, at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet separator/feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rolls along output guides 31 into catch tray 32, which is suitably an offsetting catch tray, via output nip rolls 31*a*.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger.

As mentioned above, sheets may be fed from either the main tray 26 or the auxiliary tray 27. The auxiliary tray is of larger size than the main tray, enabling a wide choice of paper sizes and types to be fed from it. The trays are physically located int he lower part of the machine below the photoreceptor drum 1.

An automatic document feeder 40 is arranged over the platen 13 by which documents stacked in an input tray 41 at the right hand side are fed onto the platen for copying and then fed off the platen into a catch tray 42 arranged over the platen after copying. Documents are stacked in the input or feed tray 41 on a stack support surface 50 against a retractable front registration gate 51 between a fixed side registration edge 52 and an adjustable side edge guide 53. Upon retraction of the gate 51, sheets are advanced by a bank of rotatin gpaddles 54 between input guides 55, 56 leading to the platen 13. Transport across the platen 13 is by a white wide friction drive belt 57 extending across the platen over input and output rolls 58, 59. A pivoting edge 60 is arranged across the end of the platen glass 13. This is raised to register a document on the platen and then lowered for sheet ejection into the catch tray 42. For a single copy, the edge 60 may remain lowered and the copy be made by transporting the document across the platen 13 in a continuous movement at a constant velocity with the optical system 12 stationary. Sheets are conveyed into the catch tray 42 around a direction reversing guide 61 by pairs of coacting transport rolls 62, 63.

The document feeder will not be described in detail.

Referring to FIGS. 3 to 12, documents to be copied are stacked on the stack support surface 50 with the lead edge of the stack against the retractable registration gate 51 and one side edge of the stack against the fixed side registration guide 52. As shown in FIG. 4, the retractable gate coprises a plurality of fingers 51*a* carried on a pivotally mounted support 64. Retraction of the gate 51 is effected by a solenoid 65 through a wire actuator 66 connected to the support 64. The stack is registered firmly against gate 51 and fixed guide 52 by the movable side guide 53.

As best seen in FIGS. 9 to 12, the guide 53 is mounted for sliding movement across the support surface 50 to accommodate different sheet sizes to be fed. A unique feature of the stack registration system of this invention is that the adjustable guide automatically retracts or relaxes by a predetermined amoutn e.g. (1 millimeter) when it is released after bing pushed against a stack. This ensures, particularly in the case of small stacks, that the stack is not squashed or compressed by the registration guides which could lead to misfeeds or skewed feeds. It is achieved, as seen schematically in FIG. 9, by making the adjustable side edge guide 53 in two parts 71, 72 which are resiliently interconnected.

As shown in FIGS. 9 to 12, the main part 71 of the guide comprises the edge guide member 73 whish is grasped by the operator and pushed against the side of the stack. This part 71 rests on the top of the input tray stack surface 50 and is attached via a compression spring 74 to a frictional slider 72 which moves in a slideway 75 on the udnerside of the input tray 41. The spring 74 is mounted in a recess 76 in the underside of main guide body 71 between one end of the recess and a detent 77 on the slider 72 which projects into the recess 76. The two parts are held together by projection 78, fitted with clips 78*a*, on the body 71 which pass through slots 79 in the slider 72 and also serve to determine the raltive movement of the parts 71, 72.

The slider 72 itself is genrally U-shaped in cross-section with the limbs of the U forming spring arms 72*a* which frictionally engage the sides of the slideway 75. The forces are determined so that the frictional force required to overcome movement of the frictional slider 72 is greater than that required to push the main body 71 of the guide to its registered position where it is released by the user. Thus, as the guide 53 is moved towards the edge of the stack by pushing on the main body 72 by means of the member 73, the main body moves to the right in FIG. 9 by an amount relative to the slider predetermined by slots 79, so compressing the spring 74. When the guide 53 has reached its desired position and is released by the user, the spring 74 expands and retracts the main body 71 relative to the slider 72 which is frictionally held in the slideway 75.

The slider 72 is made sufficiently long such that angular tolerance is minimised and frictional lock-up is prevented where the user pushes against one end of the edge guide member 73. Also, the spring arms 72*a* are made sufficiently long such that they will give a relative constant frictional force.

As shown, the main body 71 os the guide 53 includes a ski portion 80 which is tapered so as to ensure the stack edge is lifted up on top of the ski as the guide is moved towards the stack.

The documents are fed by a friction retard top sheet feeder 45 coprising the paddles 54 and a series of high friction retard pads 90 arranged on an inclined low friction ramp 91. The paddles 54, inclined ramp 91 and retard pads 90 are so arranged in accordance with a feature of the invention that a sheet advanced off the top of the stack will engage the ramp 91 below the retard pads 90 so avoiding stubbing of the lead edge of the sheet which can cause misfeeds and skew. The ramp 91 forms part of the lever input guide 55.

The paddes 54 are mounted on a shaft 92 arranged over the stack support surface 50 and extending transversely of the sheet feed direction indicated by arrow 94. The paddles each comprise two blades 54*a* mounted on a hub 93 surrounding the shaft 92. The blades 54*a* ahve a hollow semi-cylindrical configuration as seen in FIGS. 4 and 5 and extend radially from the hub 93 in opposed directions with the outer surfaces of the blades relatively displaced by 180° about their cylinder axes so that they each engage the top sheet in the stack with their outer surface. The paddles are suitably made of silicone rubber. The paddles are rotated anti-clockwise as seen in FIGS. 4, 5, 7 and 8 to feed the top sheet of the stack in the direction of arrow 94. As a blade 54*a* engages the stack it flattens and spreads so as to provide good frictional contact with the paper without exerting undue pressure on the sheet which would promote multi-feeds. The "tunnel" configuration of the blades allows the blade to collapse as it strikes the document stack so that the normal force on the stack is essentially constant for varying stack heights.

The ramp 91 has a low friction surface and extends upwardly and forwards from the forward end of the tray 41 at an acute angle to the horizontal stack support surface 50 and has a transverse array of wedgeshaped retard pads 90 at spaced positions thereacross. These pads 90 are spaced from the upstream or lower end of the ramp 91 by a distance sufficient that regardless of the stack height the lead edges of all sheets fed from the stack will engage the ramp 91 below the retard pads 90, thus avoiding stubbing of the sheet which can cause misfeeds and skewed sheets. Preferably this is achieved by arranging the paddles 54*a* so that when the stack is relatively high they press the lead edge of the sheet downwards over the front of the stack so that the lead edge of the sheet engages the rap 91 below the retard pads 90. Thus, the position of the ramp 91 relative to the stack, its angle, the height of the pads 90 and the maximum height of the stack are all factors determinative of the position at which the lead edges of the sheets strike the ramps surface, given that the paddles are suitabley arranged to press the sheets downwardly below the stack.

In one embodiment in which the stack may contain up to 50 sheets of 80 gsm paper, the ramp is inclined at an angle of about 28° to the horizontal, with the pads inclined at about 7.50 to the ramp, and the pads are spaced about 10 millimetres to 15 millmetres, preferably 12.5 millimetres, from the lower end of the ramp. The ramp is suitably a stainless steel metal stamping and the retard pads are suitably of silicone rubber.

when feeding of the top document is initiated, the gate 51 lifts and the paddle shaft 92 rotates, suitably at a speed of about 454 rpm, to engage one blade 54*a* of each paddle 54 with a top sheet in the stack. The paddle/paper friction is greater than the paper/paper friction, so that the top sheet is preferentially fed forwards and is guided over the front of the stack so that its lead edge engages the ramp 91 below the retard pad 90 and is then guided up the ramp 91 and over the retard pads 90 into the guide slot between the lower and upper guides 55, 56 leading to the input nip of the platen transport. In the event of a second or subsequent sheet being delivered forward simultaneously with the top sheet, the retard pads 90 (whose friction is again such that the paper/pad friction is greater than the paper/paper friction, but also such that the paper/pad friction is less than the paper/-paddle friction) assist in separating the subsequent sheets from the top sheet being fed. For feeding each sheet the paddles 54*a* are rotated intermittently through a single revolution.

The drive system for the paddle shaft 92 is arranged so that the paddles always stop with the blades 54*a* horizontal. This ensures that documents stacks to the maximum capacity of the machine can always be inserted into the input area of the retractable gate 51 without being impeded into the input area of the retractable gate 51 without being impeded or prevented by the paddles 54. This feature eliminates the conventional need to have a positive nip drive which can be physically separated from its idler nip.

The retard pads 90 are arranged to plug into the ramp surface 91 in order that they can be readily replaced in the event of wear or contamination.

The stack support surface 50 preferably has at least in some areas a cork or similar surface or pad 95 whose frictional characteristics are similar to those of paper in order that the frictional relationships experienced by the last sheet in the stack i.e. the bottom sheet, are the same as those experienced by prior sheets.

As seen in FIGS. 3 and 6, the platen transport belt 57 is a single endless white wide betl which has a series of laterally spaced pads 101 arranged at two equal intervals along the belt. At the completion of a transport cycle one of the series of pads 101 is arranged as shown in FIGS. 3 and 6 with the lead edge of the pads 101 engaging the platen galss and forming a registration gate for the incoming sheet from the paddle feeder 45. The clearance between the document belt 57 and the platen glass 13 is critical and is arranged so that there is virtual contact between the document belt and the glass. This allows the lead edge of the document to penetrate under the belt a little way but then arrests the document due to the friction between the document and the belt on the glass. The document belt is stationary at this point in the cycle. The uniformity of the wedge formed by the pads 101 across the glass 13 forms a registration feature which sets the document lead edge approximately perpendicular to the feed direction. The system has shown that any small degree of misalignment at this tage is removed when the document lead edge stops up against the hard registration edge 60 at the downstream end of the platen where the document is placed for copying.

It has also been found that the wedge parameter can be made such that while it is sufficiently resisitive to arrest the incoming document, it allows the document to penetrate sufficiently to ensure that it is carried across the platen glass by belt/document friction when the belt is subsequentially rotated. Thus the system is intended to accept a document from the input area, stop it essentially square to the feed direction, and permit the document to be subsequentially transported, by rotation of the document belt 57, across the platen glass 13.

The configuration shown incorporates the raised pads 101 on the surface of the belt, spaced in a line across its width (front to back) across the machine. Behind each pad 101, there is a groove or recess cut into the drive roll 58, which allow the belt to be depressed locally without significant increase in the normal force on the pads 101. The pads 101 themselves do not therefore become significantly compressed if the centre of the drive roll should be marginally low. It is arranged that these small pads 101 are always parked at the cusp between the belt 57 and the glass 13, so that the incoming document is actually fed into the wedge between the pad and the glass. Thus no active gate is required to achieve registration of documents parallel to the feed direction.

When a sheet input sensor detects the presence of a sheet at the transport nip, the belt 57 is driven to advance the document across the platen to the registration gate 60 for registration for copying by scanning the optical system of the copier across the document.

The belt 57 is entrained over the guide rollers 58 and 59. The roller 58 at the input end is driven and belt tensioning is achieved by adjustment of the roller 59 at the output end of the platen. A nip roll 97 presses the belt against the platen glass adjacent the registration gate 60.

As explained above, the document is registered against the retractable registration edge 60 for copying. Ejection to the output tray is between a pair of semi-cylindrical guides forming reversing guide 61 and the two pairs of foam transport rolls 62, 63. The documents are, of course, stacked face down in the input tray 41 to that thier imaged faces are seen by the optical system of the copier. They are collected face-up in the output tray 42 which is conveniently arranged over the platen transport and upwardly inclined to aid uniform stacking of the documents.

The document handler 40 has an outer cover 98 and can hinge open to approximately 55° about its rear edge by lifting up the front edge thereof. This allows the platen to be used for copying books, special documents, etc.

It will be understood that various modifications and changes may be made to the specific details refered to herein without departing form the scope of the invention as defined in the appended claims.

For example while the paddle configuration illustrated has the paddle shaft 92 perpendicular to the feed direction 93, the shaft 92 may instead be inclined to the feed direction in order to impart a lateral component to the movement of a document, and so register the document more positively against the registration edge.

What is claimed is:

1. In a document sheet feeder for a copier with a document stacking tray with variabley spaced-apart edge guides, in which flimsy document sheets of various dimensions must be stacked in said tray and fed out from said tray between said edge guides without mis-stacking or binding between said edge guides, yet in which said edge guides must maintain substantial alignment of said documents by maintaining said edge guides spaced apart by a distance only slightly greater than the dimensions of the documents being so stacked and fed, wherein one of said edge guides is fixed and the other is resettable to variable spacings relative thereto to accommodate different document sheet dimensions, and wherein said resettable side guide is resettable by a slideable movement of said side guide and an integral slide mounting therefor which is integral with said tray, the improvement wherein:

said resettable edge guide is slideably mounted to said slide mounting therefor with a preset limited degree fo allowable independent slideable movement between said resettable edge guide and said slide mounting, and wherein preset spring force spring means are mounted to interconnect between said resettable edge guide and said slide mounting thereof, said spring means being adapted to be compressed upon said resetting of said edge guide, and said spring means being adapted to expand after said resettable edge guide has been reset to automatically slideably move said resettable edge guide away from said fixed edge guide by a small preset limited distance by said slideable movement between said resettable edge guide and its said slide mounting.

whereby said resettable edge guide retracts by said limited distance away from the documents when it is released after being pushed against a stack of documents in said tray.

2. A document sheet feeder according to claim 1 in which said limited distance movement of said resettable edge guide by said spring means is approximately 1 mm.

* * * * *